United States Patent [19]

Taddeo et al.

[11] Patent Number: 5,052,302

[45] Date of Patent: Oct. 1, 1991

[54] UNPRESSURIZED COMBUSTIBLE PRIMER FOR CANNON CARTRIDGES

[75] Inventors: Ralph M. Taddeo, St. Petersburg, Fla.; Robert W. Deas, Aberdeen; Lang-Mann Chang, Fallston; John Grosh, Belcamp, all of Md.

[73] Assignees: Olin Corporation, Cheshire, Conn.; United States Government Department of Defense, Washington, D.C.

[21] Appl. No.: 558,019

[22] Filed: Jul. 26, 1990

[51] Int. Cl.[5] ..... F42C 19/085

[52] U.S. Cl. ..... 102/204; 102/470

[58] Field of Search ..... 102/204, 202, 282, 470

[56] References Cited

U.S. PATENT DOCUMENTS

| | | | |
|---|---|---|---|
| 2,430,888 | 11/1947 | Regad et al. | 102/470 |
| 2,436,826 | 3/1948 | Regad et al. | 102/204 |
| 3,182,595 | 5/1965 | Hassmann | 102/204 |
| 3,667,391 | 6/1972 | Amiable et al. | 102/202 |
| 3,899,973 | 8/1975 | Brocart | 102/204 |
| 4,770,099 | 9/1988 | Brede et al. | 102/204 |
| 4,917,017 | 4/1990 | Beltz | 102/470 |

*Primary Examiner*—Charles T. Jordan

*Attorney, Agent, or Firm*—John R. Wahl

[57] ABSTRACT

A combustible bayonet type primer for combustible cannon cartridge cases comprises a primer head assembly adapted to be inserted in a cartridge case, a tubular housing made of a combustible material, an igniter strand axially disposed in said housing, and a confining means for confining one end of the igniter strand so that the initial ignition rate is about 1000 m/s. The ignited strand in turn ignites a black powder charge contained within a cloth bag within the tubular housing. The housing is an unpressurized container for the igniter strand and the black powder charge and is consumed during the burn of the propellant bed along with the igniter strand and the combustible case.

38 Claims, 1 Drawing Sheet

UNPRESSURIZED COMBUSTIBLE PRIMER FOR CANNON CARTRIDGES

BACKGROUND OF THE INVENTION

This invention generally relates to ammunition ignition systems and more particularly to an ignition device for combustible cartridge cases.

Ammunition for use in tank cannons may be advantageously manufactured using a combustible case component. This minimizes the volume of spent case material inside the confined space of the tank in which such ammunition is used. The conventional combustible case cartridge comprises a projectile attached to the forward end of a cylindrical combustible case containing a propellant bed. Attached to the other end of the combustible case is a metal cartridge case head having a bayonet type primer extending from the head through the rear of the combustible case into the propellant bed.

A conventional ignitor assembly of the bayonet type is disclosed in U.S. Pat. No. 3,182,595 to Hassmann. This conventional ignitor assembly had a tubular metal body having nozzle-like flash holes through the body. This was the first patent to disclose the use of benite strands contained within the body. This benite material is essentially an extruded form of black powder. The metal tube formed a pressure vessel for the benite.

One current tank cartridge having a combustible case is the M865 cartridge. The M865 tank cartridge utilizes a typical bayonet type primer similar to the Hassman primer. This cartridge has a M123 primer head assembly connected to a strong heavy steel wall tube containing an energetic ignition material such as benite with small nozzle like holes through the wall of the tube. These holes direct the ignition flame into the propellant bed.

Current primer practice is to ignite the energetic material, i.e. benite, contained within this tube from one end and to depend on a critical development of pressure within the tube to rapidly stimulate the rate of burn of the energetic material. The rate of propagation of the burn depends primarily on the pressure. Thus, the heavy steel wall tube of the conventional bayonet primer must act as a pressure vessel to try to acheive almost instantaneous ignition throughout the tube.

The problem encountered with this bayonet primer configuration in combustible cases is that after firing the round and ejection of the metal head containing the primer from the breech of the cannon, the hot steel tube projects a long distance out of the cartridge case head and presents a serious potential hazard to personnel. During the ignition process, the primer tube becomes extremely hot. In addition, if this hot steel tube comes into contact with the combustible case of the next round of ammunition to be fired, or if such a case is dropped on the hot primer tube, the case may be ignited with disastrous results.

A solution to this problem is to provide a bayonet primer with a combustible case that is consumed during the propellant burn. One such conventional bayonet type primer is illustrated and disclosed in U.S. Pat. No. 4,770,099 to Brede et al. The Brede Patent discloses a bayonet type primer having a tube made of a combustible material filled with black powder, benite, or other initiating charge material and an electrical initiator positioned midway between the ends of the tube. A pressure container is still required as this primer utilizes strands of benite which are highly dependent upon pressure for the rate of propagation. However, ignition of the igniter charge thus takes half the time to travel to the ends of the tube as does a similar conventional primer ignited from only one end. Thus the Brede et al Patent attempts to solve the problem of igniting a long propellant bed with as much longitudinal simultaneity as possible by moving the ignition point to the center of the tube rather than one end. This design is a clever but very expensive attempt to rearrange the components of a standard M125 style bayonet primer.

Another combustible primer which contains an igniter strand of penthrite and calcium silicide is disclosed in U.S. Pat. No. 3,899,973 to Brocart. In the Brocart primer, a hollow felt like cylinder made of nitro cellulose and a latex resin binder is utilized. A long central bore through the cylinder holds a detonating fuse which comprises a cylindrical lead sheath surrounding a charge of penthrite and calcium silicide. Use of such an igniter strand housed in lead creates undesirable residual products. In addition, penthrite is an explosive with a high brisance which is very undesirable as a cartridge propellent igniter.

It is therefore a general object of the present invention to provide a combustible bayonet primer which has an unpressurized tubular housing of combustible material and has an ignition velocity on the order of at least 1000 meters per second.

It is another object of the present invention to provide an inexpensive combustible bayonet primer suitable for use in long propellant bed applications.

SUMMARY OF THE INVENTION

The present invention comprises a metal primer head assembly adapted to be inserted into a combustible cartridge case base, a hollow combustible tubular housing containing an ignition charge and an igniter strand axially disposed in the housing. This end of the housing is connected to the head assembly. The strand has one end extending into the head assembly through this end of the housing and the other end supported by an end plug in the other end of the housing. A confining means placed around the end of the igniter strand extending into the primer head assembly confines a portion of the strand. The igniter strand is preferably a nitrocellouse strand within a polyethylene sheeth. The confinement means around one end of the igniter strand produces a high pressure condition in this portion upon strand ignition which causes propagation of the ignition flame along the strand at a speed of between 1300–1500 meters per second so long as the strand is confined for at least 1.4 inches of its length. The nominal propagation speed of an unconfined igniter strand is only 300 meters per second. Thus the initial confinement of the igniter strand boosts this propagation speed to at least a thousand meters per second. In addition, the combustible primer tube need not confine the igniter strand or the igniter charge once this propagation speed has been achieved. The propagation velocity of between 1300 to 1500 meters per second continues along the strand once the velocity is established. Therefore the tubular body made of a combustible material does not have to be a pressure vessel. The only purpose of the tube is to provide a means to insert the primer into the bed and provide a support structure for the igniter strand.

DETAILED DESCRIPTION

Figure 1:
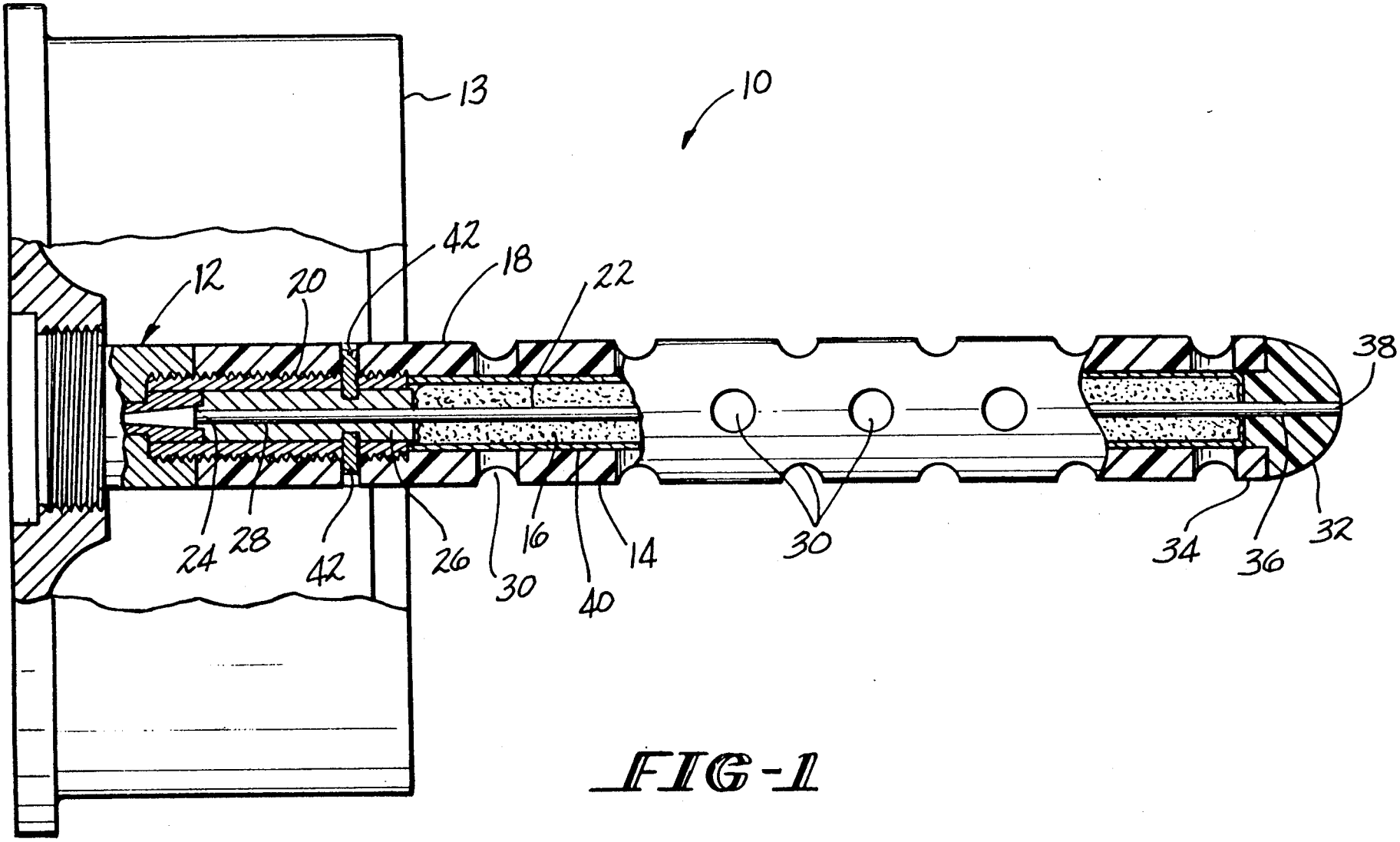
FIG. 1 is a sectional elevation view of the combustible bayonet primer of the invention installed within a conventional metal cartridge case base.

One preferred embodiment of the combustible bayonet primer in accordance with the present invention is illustrated in FIG. 1. The bayonet primer 10 in accordance with the present invention includes a conventional metal primer head assembly 12 which is threaded into a metal cartridge case base 13 which is in turn adapted to be connected to a combustible cartridge case (not shown),and a hollow combustible tubular housing 14 containing an ignition charge 16.

The housing 14 has one end 18 connected to the metal primer head assembly 12 via a threaded connector 20. An ignitor strand 22 is axially disposed through the housing 14 and through the igniter charge 16 and has one end 24 extending through the one end 18 of the combustible housing 14 into the primer head assembly 12. This end 24 of the igniter strand 22 passes through a confining means comprising a cylindrical adapter 26. The cylindrical adaptor 26 confines a portion of the igniter strand 22 at the end 24 to produce a high pressure condition in the central bore 28 of the cylindrical adapter 26 when the end 24 of igniter strand 22 is ignited.

The tubular combustible housing 14 is preferably made of a compressed nitrocellouse material which may optionally be structurally reinforced with consumable webbing, fibers, or strands. Housing 14 has a plurality of perforations 30 extending along its length and circumference, spaced at approximately one and one half inch intervals. These perforations 30 are preferably about a half inch in diameter and spaced about 90 degrees apart. The housing 14 is preferably about one inch in diameter and has a wall thickness of about 0.2 inch. The combustible housing 14 is preferably formed of nitrocellouse sheet material which is wrapped or layered to form a tube and may contain various additives to enhance combustion.

A dome shaped end plug 32 closes the opposite end 34 of the tubular housing 14. The dome shaped end plug 32 has a central axial bore 36 therethrough receiving and supporting the opposite end 38 of the ignitor strand 22. The end plug 32 may also contain radial bores to enhance flame propagation therethrough. The end plug 32 is molded nitrocellouse. Its primary purpose is to close the end of the tubular housing 14, support the end 38 of the igniter strand 22 and push large grains of propellant aside during insertion of the primer through the cartridge case into the propellant bed.

The igniter strand, suspended between the cylindrical adaptor 26 and the end plug 32 along the central axis through the combustible housing 14, is a woven nitrocellouse strand which has a unique property in that its rate of propagation is as high as 1500 meters per second with relative low brisance. It consist of strands of nitrocellouse filaments coated with supplementary fuels and oxidizers conveniently packaged in a polyethylene tube. This igniter strand is commercially made and is available from Atlas Powder Company. Other similar igniter strand products may be used in this application provided that the minimum rate of propagation is 1000 meters per second and provided that the outcome is low brisance i.e. high heat.

The igniter charge 16 is preferably black powder or benite contained within a fabric bag 40 which may be made of rayon or other combustible material. The fabric bag 40 confines the ignitor charge 16 to the central space within housing 14 and prevents loss of the ignitor charge 16 through the relatively large perforations 30.

The cylindrical adapter 26 surrounding and confining the rear end 24 of the igniter strand 22 is preferablly made of metal. This adaptor confines, for a minimum of the first 1.4 inches of its length, the igniter strand in order to obtain the desired propagation velocity of 1300–1500 meters per second. Without the use of this adapter to confine the end portion of the igniter strand 22, the igniter strand propagation velocity would be only 300 meters per second. The cylindrical adapter 26 also acts to maintain in position the end 24 of the igniter strand 22 to accept the energetic output of the primer head assembly 12.

The primer head assembly 12 may be any conventional head loading assembly provided its output is equivalent to approximately 3 grains of black powder. The ignitor charge 16 may be black powder or may be also boron potassium nitrate which performs equally well.

Our tests of the combustible primer in accordance with this embodiment of the invention, the results of which are shown in the Table below, were conducted using Mil-P-223(*b*) black powder class 1 in a M865 tank cartridge. These results illustrate that the primer of the present invention functions comparably to the standard M865 practice cartridge having a standard M125 metal tube primer.

M865
COMBUSTIBLE PRIMER GUN FIRING TEST RESULTS

| | 24 HR CONDITIONING TEMP | PRESSURE P.S.I. BREECH | PRESSURE P.S.I. SHOULDER | (T4) ACTION TIME MS | CALC MV FPS | Δ P. P.SI. NEG | Δ P. P.SI. POS |
|---|---|---|---|---|---|---|---|
| STANDARD M865 | 21° C. | 69273 | 67698 | 28.0 | 1665 | 4786 | 1574 |
| STANDARD M865 | 21° C. | 69355 | 67590 | 33.8 | 1697 | 2136 | 1766 |
| COMBUSTIBLE PRIMER IN M865 | 21° C. | 69245 | 67454 | 31.7 | 1677 | 1508 | 1791 |
| BROKEN COMBUSTIBLE PRIMER IN M865 | 21° C. | 71121 | 69326 | 25.7 | M | 2706 | 1795 |
| COMBUSTIBLE PRIMER IN M865 | 63° C. | 79676 | 77899 | 20.5 | 1725 | 3408 | 1777 |
| COMBUSTIBLE PRIMER IN M865 | 63° C. | 80476 | 78902 | 23.1 | 1717 | 1807 | 1573 |
| COMBUSTIBLE PRIMER IN M865 | −46° C. | 60105 | 58524 | 62.7 | 1617 | 393 | 1581 |
| COMBUSTIBLE PRIMER IN M865 | −46° C. | 59640 | 58437 | 62.8 | 1610 | 1088 | 1204 |

The key to the operability of the present invention as mentioned above is the confinement of at least 1.4 inches of the igniter strand 22 by some means during ignition in order to attain a propagation velocity of 1300–1500 meters per second. Once this velocity is obtained within the confinement region, no further confinement is necessary. The ignition velocity continues along the strand 22 at the same velocity. Thus, the combustible housing 14 need not act as a pressure vessel to ensure that the flame propagation is fast enough. Thus, the combustible housing 14 could simply be a skeleton support structure for rigidly supporting the strand and the igniter charge in the fabric bag 40.

In the illustrated embodiment of the combustible bayonet primer 10, the tubular housing 14 and the cylindrical adapter 26 are secured to the threaded connector via set screws 42. Other means of securing the housing 14 to the primer head assembly 12 and securing the cylindrical adaptor 26 within housing 14 may alternatively be utilized. For example, these components may be glued together rather than threaded and set screwed as shown.

The fabric bag 40 is used to contain the particles of black powder inside the combustible tube housing 14. Without the cloth fabric bag 40, the particles of the ignitor charge 16 would leak out the half inch holes in the combustible tube 14. The fabric bag 40 positions the particles of black powder in close proximity to the igniter strand 22 so that the strand 22 may effectively ignite the black powder igniter charge 16. This fabric bag 40 may be made of any convenient cloth material which offers little resistance to the deployment of the burning black powder after ignition.

The present invention discards the old notion of using a pressure vessel to ensure the propagation velocity of the ignited charge. Instead, the present invention ignites a central charge so rapidly that it approaches longitudinal simultaneity and does not need to discharge the hot gas and particles through tiny holes in a pressure vessel as does the conventional metal tube priming systems. This invention is a true departure from prior art and current production primers in that it distributes the products of the initiation of the central charge to the surrounding propellant bed immediately. These products are not metered through tiny nozzle like holes but are thrown out into the bed through very large holes at the instant of ignition.

While the invention has been described above with reference to specific embodiments thereof, it is apparent that many changes, modifications and variations can be made without departing from the inventive concept disclosed herein. For example, the illustrated embodiment of the primer 10 includes half inch perforations 30. These perforations need not be circular holes but may also be large slots or a coarse mesh or any non-restrictive support for the fast burning igniter strand 22 surrounded by the igniter charge 16 contained in the fabric bag 40. Accordingly, it is intended to embrace all such changes, modifications and variations that fall within the spirit and broad scope of the appended claims. All patent applications, patents and other publications cited herein are incorporated by reference in their entirety.

What is claimed is:

1. A combustible bayonet primer comprising:

a metal primer head assembly adapted to be inserted into a combustible cartridge case base;

a nonconfining hollow combustible tubular housing containing an ignition charge, said housing having one end axially connected to said head assembly;

an igniter strand axially disposed in said housing, said strand having an end extending into said head assembly through said one end of said housing; and a confining means around said end of said igniter strand for confining a portion of said strand during ignition to produce a high pressure condition in said end when said primer assembly ignites said igniter strand.

2. The primer according to claim 1 wherein said housing has a plurality of perforations therethrough.

3. The primer according to claim 2 wherein said confining means is a cylindrical adapter positioned between said housing and said assembly, said adapter having a central axial bore therethrough, said end of said igniter strand extending through said bore in a tight fitting relationship whereby ignition of said confined strand in said bore propagates at a speed of at least 1000 m/s along the length of said strand in said tubular housing.

4. The primer according to claim 3 wherein said adapter connects said one end of said housing to said primer assembly.

5. The primer according to claim 1 wherein said ignition charge is black powder.

6. The primer according to claim 5 wherein said tubular housing is made of a nitrocellulose material.

7. The primer according to claim 1 further comprising a dome shaped plug at the other end of said tubular housing for penetrating into a bed of propellant as said primer is inserted in a cartridge case.

8. The primer according to claim 5 further comprising a fabric bag surrounding and containing said black powder in said tubular housing.

9. The primer according to claim 8 wherein said housing has a plurality of perforations therethrough.

10. The primer according to claim 9 wherein said confining means is a cylindrical adapter positioned between said housing and said assembly and having a central axial bore therethrough, said end of said igniter strand extending through said bore in a tight fitting relationship whereby ignition of said confined strand propagates at a speed of at least 1000 m/s along the length of said strand in said tubular housing.

11. The primer according to claim 10 wherein said adapter connects said one end of said housing to said primer assembly.

12. The primer according to claim 11 wherein said adapter threadably engages with both said tubular housing and said primer assembly.

13. The primer according to claim 12 further comprising a dome shaped plug at the other end of said tubular housing for penetrating into a bed of propellant as said primer is inserted in a cartridge case.

14. The primer according to claim 2 wherein said ignition charge is black powder contained in a cloth bag within said tubular housing.

15. The primer according to claim 14 wherein said confining means is a cylindrical adapter positioned between said housing and said assembly and having a central axial bore therethrough, said end of said igniter strand extending through said bore in a tight fitting relationship whereby ignition of said confined strand propagates at a speed of at least 1000 m/s along the length of said strand in said tubular housing.

16. The primer according to claim 15 wherein said adapter connects said one end of said housing to said primer assembly.

17. The primer according to claim 16 wherein said tubular housing is made of a nitrocellulose material.

18. The primer according to claim 17 further comprising a dome shaped plug at the other end of said tubular housing for penetrating into a bed of propellant as said primer is inserted in a cartridge case.

19. The primer according to claim 18 further comprising a fabric bag surrounding and containing said black powder in said tubular housing.

20. A combustible bayonet primer comprising:

a metal primer head assembly adapted to be inserted into a combustible cartridge case base;

a hollow nonconfining combustible tubular housing containing an ignition charge, said housing having one end axially connected to said head assembly;

an igniter strand axially disposed through said housing, said strand having an end extending into said head assembly through said one end of said housing; and a confining means around said end of said igniter strand for confining at least about 1.4 inches of said strand during ignition to produce a high pressure condition in said end when said primer assembly ignites said igniter strand.

21. The primer according to claim 20 wherein said housing has a plurality of perforations therethrough.

22. The primer according to claim 21 wherein said confining means is a cylindrical adapter positioned between said housing and said assembly, said adapter having a central axial bore therethrough, said end of said igniter strand extending through said bore in a tight fitting relationship whereby ignition of said confined strand propagates at a speed of at least 1000 m/s along the length of said strand in said tubular housing.

23. The primer according to claim 22 wherein said adapter connects said one end of said housing to said primer assembly.

24. The primer according to claim 20 wherein said ignition charge is black powder.

25. The primer according to claim 24 wherein said tubular housing is made of a nitrocellulose material.

26. The primer according to claim 20 further comprising a dome shaped plug at the other end of said tubular housing for penetrating into a bed of propellant as said primer is inserted in a cartridge case.

27. The primer according to claim 24 further comprising a fabric bag surrounding and containing said black powder in said tubular housing.

28. The primer according to claim 27 wherein said housing has a plurality of perforations therethrough.

29. The primer according to claim 28 wherein said confining means is a cylindrical adapter positioned between said housing and said assembly and having a central axial bore therethrough, said end of said igniter strand extending through said bore in a tight fitting relationship whereby ignition of said confined strand propagates at a speed of at least 1000 m/s along the length of said strand in said tubular housing.

30. The primer according to claim 29 wherein said adapter connects said one end of said housing to said primer assembly.

31. The primer according to claim 30 wherein said adapter threadably engages with both said tubular housing and said primer assembly.

32. The primer according to claim 31 further comprising a dome shaped plug at the other end of said tubular housing for penetrating into a bed of propellant as said primer is inserted in a cartridge case.

33. The primer according to claim 21 wherein said ignition charge is black powder contained in a cloth bag within said tubular housing.

34. The primer according to claim 33 wherein said confining means is a cylindrical adapter positioned between said housing and said assembly, said adapter having a central axial bore therethrough, said end of said igniter strand extending through said bore in a tight fitting relationship whereby ignition of said confined strand propagates at a speed of at least 1000 m/s along the length of said strand in said tubular housing.

35. The primer according to claim 34 wherein said adapter connects said one end of said housing to said primer assembly.

36. The primer according to claim 35 wherein said tubular housing is made of a nitrocellulose material.

37. The primer according to claim 36 further comprising a dome shaped plug at the other end of said tubular housing for penetrating into a bed of propellant as said primer is inserted in a cartridge case.

38. The primer according to claim 37 further comprising a fabric bag surrounding and containing said black powder in said tubular housing.

* * * * *